US008544983B2

(12) United States Patent
Tanaka et al.

(10) Patent No.: US 8,544,983 B2
(45) Date of Patent: Oct. 1, 2013

(54) IMAGE FORMING APPARATUS

(75) Inventors: Akiyoshi Tanaka, Kanagawa (JP); Yoichi Ito, Tokyo (JP); Soyoung Park, Kanagawa (JP); Kuniyori Takano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 71 days.

(21) Appl. No.: 13/222,164

(22) Filed: Aug. 31, 2011

(65) Prior Publication Data

US 2012/0056933 A1 Mar. 8, 2012

(30) Foreign Application Priority Data

Sep. 2, 2010 (JP) ..... 2010-196520

(51) Int. Cl.
*B41J 2/165* (2006.01)

(52) U.S. Cl.
USPC ..... 347/30; 347/29; 347/6; 347/33

(58) Field of Classification Search
USPC ..... 347/30, 6, 29, 33
See application file for complete search history.

(56) References Cited

U.S. PATENT DOCUMENTS

| | | | | |
|---|---|---|---|---|
| 2004/0227784 | A1* | 11/2004 | Lodal et al. | 347/33 |
| 2010/0026758 | A1 | 2/2010 | Tanaka et al. | |
| 2010/0061745 | A1 | 3/2010 | Ito et al. | |
| 2010/0207990 | A1 | 8/2010 | Ito et al. | |
| 2011/0109692 | A1 | 5/2011 | Ito et al. | |
| 2011/0141181 | A1 | 6/2011 | Ito et al. | |

FOREIGN PATENT DOCUMENTS

| | | | |
|---|---|---|---|
| JP | 4-141437 | | 5/1992 |
| JP | 10-286974 | | 10/1998 |
| JP | 2000-15839 | | 1/2000 |
| JP | 2004-58446 | | 2/2004 |
| JP | 2005-225163 | * | 8/2005 |
| JP | 2009-90612 | | 4/2009 |

* cited by examiner

*Primary Examiner* — Henok Legesse
(74) *Attorney, Agent, or Firm* — Cooper & Dunham LLP

(57) ABSTRACT

An image forming apparatus including: a recording head having a nozzle surface in which nozzles to eject liquid droplets in a horizontal direction or a direction slanted from the horizontal direction are formed, the nozzle surface being disposed in a vertical direction or a direction slanted from the vertical direction; a head tank to supply liquid to the recording head; a suction cap to cap the nozzle surface of the recording head; a suction member connected to the suction cap to suck out liquid from the nozzles by the suction cap; a valve member to open or close a sealed space formed by capping the nozzle surface with the suction cap to atmosphere; a liquid supplier to supply the liquid to the head tank and return the liquid from the head tank; and a control unit to control servicing of the recording head.

4 Claims, 8 Drawing Sheets

IMAGE FORMING APPARATUS

CROSS-REFERENCE TO RELATED APPLICATIONS

This patent specification is based on Japanese Patent Application No. 2010-196520, filed on Sep. 2, 2010 in the Japan Patent Office, which is hereby incorporated herein by reference in its entirety.

BACKGROUND

1. Technical Field

This disclosure relates generally to an image forming apparatus to form an image using a recording head. The recording head has a nozzle surface disposed in a vertical direction or a direction slanted from the vertical direction, and liquid droplets are ejected in a horizontal direction or a direction slanted from the horizontal direction from nozzles formed in the nozzle surface of the recording head.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head that ejects droplets of a recording liquid such as ink onto a sheet of a recording medium while the sheet is conveyed to form an image on the sheet.

Examples of the inkjet recording device include a serial-type image forming apparatus, in which the recording head ejects ink droplets while moving in a main scanning direction to form an image on the sheet as the sheet is moved in a sub-scanning direction perpendicular to the main scanning direction, and a line-type image forming apparatus equipped with a line-type recording head that ejects ink droplets and does so without moving to form an image on the sheet as the sheet is moved in the sub-scanning direction.

One example of an image forming apparatus employing the liquid ejection recording method conveys a recording medium such as a sheet of paper in a vertical direction or a direction slanted from the vertical direction, and the recording head ejects ink droplets in a horizontal direction or a direction slanted from the horizontal direction to the sheet while moving reciprocally back and forth so as to form an image on the sheet. Specifically, the nozzle surface of the recording head in which the nozzles to eject ink droplets are formed is disposed vertically or at a slant from the vertical direction, and the recording head ejects the ink droplets horizontally or at a slant from the horizontal direction. (In other words, the above-described image forming apparatus employs a horizontal ejection method. Herein, the term "horizontal" includes an angular range up to 45° with respect to the horizontal, and the term "vertical" includes an angular range up to 45° from the vertical.)

In order to maintain the recording head in good condition, the image forming apparatus employing the liquid ejection recording method generally uses a maintenance device. The device has a suction cap connected to a suction pump or the like that closely contacts the nozzle surface of the recording head to suck out the ink from the nozzles. In addition, a release unit that releases pressure in the suction cap is also generally provided so as to effectively discharge ink or bubbles remaining in the suction cap after the suction of ink from the nozzles and to prevent pressure from building up within the suction cap.

There are known maintenance devices that: remove the suction cap, which is connected to the release unit, from the nozzle surface while maintaining a negative pressure within the suction cap; release pressure in the suction cap while ink droplets are ejected from the nozzles when the suction of ink from the nozzles is about to end; apply positive pressure to the nozzles during a period of time extending from the end of the suction of ink to the removal of the suction cap from the nozzle surface; or set conditions for preliminary ejection of ink droplets from the nozzles for maintenance based on positions of the nozzles relative to the recording head.

In a case in which multiple nozzle arrays each constructed of nozzles and ejecting ink droplets of a different color are formed in the nozzle surface of the recording head in a full-color image forming apparatus employing the horizontal ejection method described above, when the nozzle surface is capped with a single suction cap to suck out the ink from the nozzles for maintenance, ink of different colors or mixed colors may enter the nozzles upon the suction of ink, thereby causing color mixing during image formation. In addition, because the suction cap is also disposed vertically, ink remaining in the suction cap may drip off upon removal of the suction cap from the nozzle surface of the recording head.

SUMMARY

This disclosure provides a novel image forming apparatus to prevent color mixing during image formation. In the image forming apparatus, liquid remaining in a suction cap that covers a nozzle surface of a recording head is efficiently discharged in order to prevent dripping of the liquid from the suction cap.

In one illustrative embodiment, an image forming apparatus includes: a recording head having a nozzle surface in which nozzles to eject liquid droplets in a horizontal direction or a direction slanted from the horizontal direction are formed, the nozzle surface being disposed in a vertical direction or a direction slanted from the vertical direction; a head tank to supply liquid to the recording head; a suction cap to cap the nozzle surface of the recording head; a suction member connected to the suction cap to suck out liquid from the nozzles by the suction cap; a valve member to open or close a sealed space formed by capping the nozzle surface with the suction cap to atmosphere; a liquid supplier to supply the liquid to the head tank and return the liquid from the head tank; and a control unit to control servicing of the recording head. The control unit causes the suction cap to cap the nozzle surface and the suction member to be driven so as to suck out liquid from the nozzles, the liquid supplier to supply the liquid so as to pressurize the head tank after the suction of liquid, the valve member to open the sealed space to atmosphere, the suction member to discharge liquid remaining in the suction cap after opening the sealed space to atmosphere, the liquid supplier to return the liquid from the head tank so as to form negative pressure in the head tank after the discharge of liquid, and the suction cap to be removed from the nozzle surface after the formation of negative pressure.

Another illustrative embodiment provides a method for controlling servicing of a recording head included in the image forming apparatus described above. The method includes the steps of sucking out liquid from the nozzles by capping the nozzle surface with the suction cap and driving the suction member, pressurizing the head tank by supplying the liquid using the liquid supplier after the sucking step, opening the sealed space to atmosphere using the valve member, discharging liquid remaining in the suction cap using the suction member after the opening of the sealed space to atmosphere, forming negative pressure in the head tank by returning the liquid from the head tank using the liquid supplier after the discharging step, and removing the suction cap from the nozzle surface after the step of forming negative pressure in the head tank.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF ILLUSTRATIVE EMBODIMENTS

Figure 1:
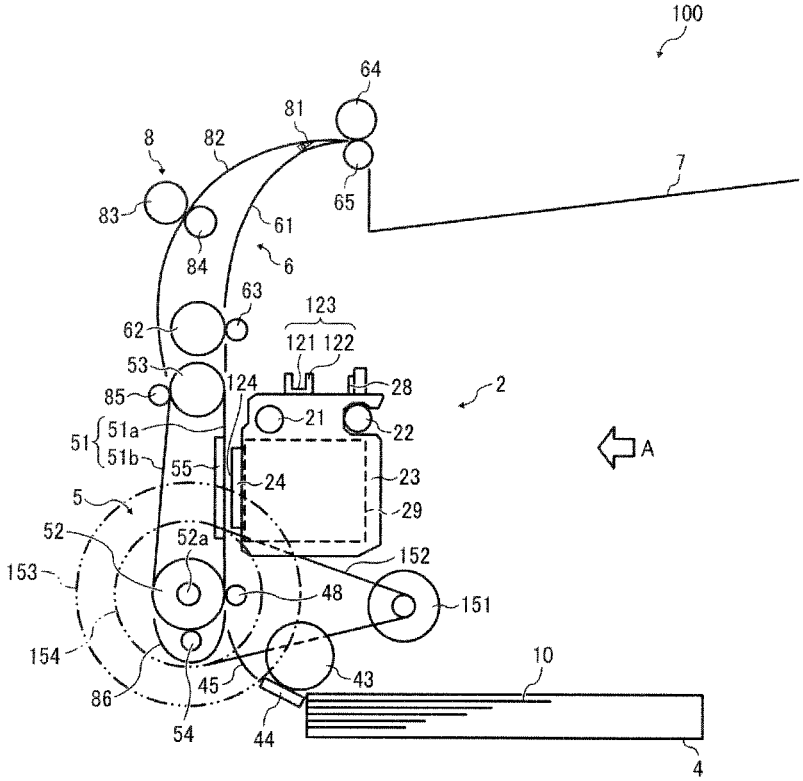
FIG. 1 is a vertical cross-sectional view illustrating an example of a configuration of an image forming apparatus according to an illustrative embodiment.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting ink droplets onto the recording medium. In this specification, an image refers to both signifying images such as characters and figures, as well as a non-signifying image such as patterns. In addition, ink includes any material which is a liquid when ejected from the recording head, such as a DNA sample, a resist material, and a pattern material. Further, an image formed on the recording medium is not limited to a flat image, but also includes an image formed on a three-dimensional object, a three-dimensional image, and so forth.

Figure 2:
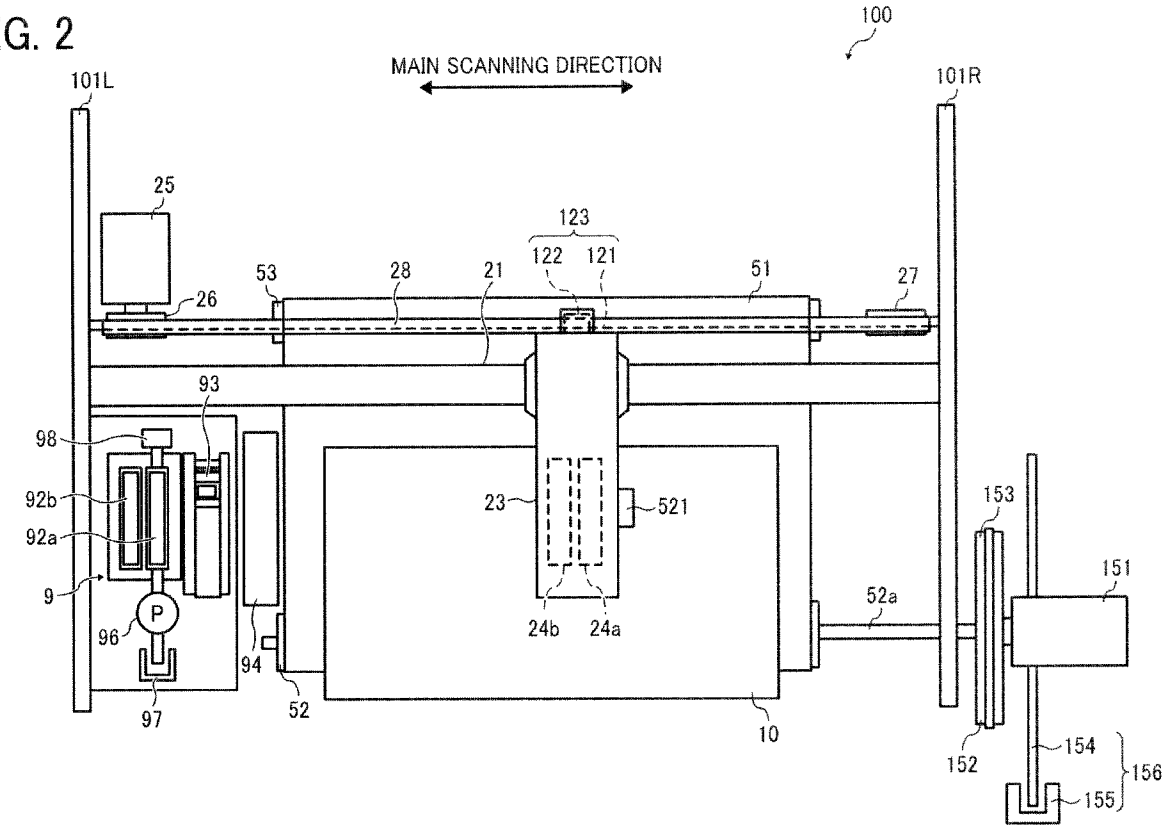
FIG. 2 is a schematic view illustrating the configuration of the image forming apparatus viewed from a direction indicated by arrow A in FIG. 1.

A description is now given of a configuration and operation of a serial-type image forming apparatus 100 according to an illustrative embodiment, with reference to FIGS. 1 and 2. FIG. 1 is a vertical cross-sectional view illustrating an example of a configuration of the image forming apparatus 100. FIG. 2 is a schematic view illustrating the configuration of the image forming apparatus 100 viewed from a direction indicated by arrow A in FIG. 1.

The image forming apparatus 100 includes an image forming unit 2, a conveyance mechanism 5, a sheet feed tray 4 provided in a lower part thereof to store a sheet 10 serving as a recording medium, and so forth. The image forming unit 2 ejects ink droplets in a horizontal direction (or a direction along the horizontal direction) to the sheet 10 to form an image on the sheet 10 while the sheet 10 fed from the sheet feed tray 4 is intermittently conveyed upward in a vertical direction (or a direction along the vertical direction) by the conveyance mechanism 5. The sheet 10 bearing the image thereon is then further conveyed upward through a discharge unit 6 to be discharged to a discharge tray 7 provided in an upper part of the image forming apparatus 100.

During duplex printing, after the image is formed on a front side of the sheet 10, the sheet 10 is conveyed from the discharge unit 6 to a reversal unit 8. Subsequently, the sheet 10 is conveyed downward by the conveyance mechanism 5 and is reversed such that an image is formed on a back side of the sheet 10 by the image forming unit 2. After the image is formed on the back side of the sheet 10, the sheet 10 is discharged to the discharge tray 7.

In the image forming unit 2, a carriage 23 in which recording heads 24*a* and 24*b* (hereinafter collectively referred to as recording heads 24) are installed is slidaby held by a main guide member 21 and a sub-guide member 22, each extended between right and left lateral plates 101R and 101L. The carriage 23 is moved reciprocally back and forth in a main scanning direction by a main scanning motor 25 via a timing belt 28 wound around a drive pulley 26 and a driven pulley 27.

Each of the recording heads 24 is constituted of a liquid ejection head that ejects ink droplets of a specific color, that is, yellow (Y), magenta (M), cyan (C), or black (K), and has a nozzle surface 124. As described in detail later with reference to FIG. 3, in the nozzle surface 124, nozzle arrays Na and Nb each constituted of multiple nozzles 124*b* to eject the ink droplets are arranged in a sub-scanning direction perpendicular to the main scanning direction. The recording heads 24 are installed such that the ink droplets are ejected in a horizontal direction. In other words, the image forming apparatus 100 employs a horizontal ejection method in which the nozzle surface 124 of each of the recording heads 24 is disposed vertically so as to eject the ink droplets horizontally.

Figure 3:
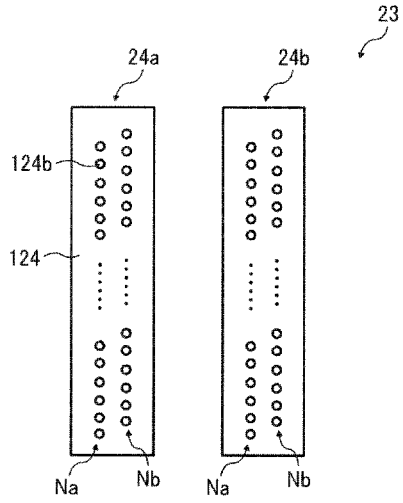
FIG. 3 is a schematic view illustrating an example of a configuration of recording heads employed in the image forming apparatus.

FIG. 3 is a schematic view illustrating an example of a configuration of the recording heads 24. Each of the recording heads 24 has the nozzle surface 124 in which the nozzle arrays Na and Nb each constituted of the multiple nozzles 124*b* are formed. Yellow liquid droplets are ejected from the nozzle array Na of the recording head 24*a* and magenta liquid droplets are ejected from the nozzle array Nb of the recording head 24*a*. Black liquid droplets are ejected from the nozzle array Na of the recording head 24*b* and cyan liquid droplets are ejected from the nozzle array Nb of the recording head 24*b*.

The liquid ejection head constituting each of the recording heads 24 may include a pressure generator to generate a pressure for ejecting the ink droplets. The pressure generator may, for example, be a piezoelectric actuator having a piezoelectric element, a thermal actuator using an electrothermal converter such as a heat-generating resistor to use a phase change caused by film boiling of a liquid, a memory metal actuator using a metallic phase change caused by a temperature change, or an electrostatic actuator using an electrostatic force. It is to be noted that a dedicated liquid ejection head that ejects a fixer to improve fixing property of ink by reacting with the ink may also be installed in the carriage 23.

Returning to FIG. 1, the carriage 23 further includes a head tank 29 that supplies ink of the specified color to the corresponding nozzle array Na or Nb in each of the recording heads 24. Ink is supplied to the head tank 29 from a main tank 11 detachably attachable to the image forming apparatus 100.

An encoder scale 121 having a predetermined pattern thereon is extended between the right and left lateral plates 101R and 101L in the main scanning direction of the carriage 23. An encoder sensor 122 including a transmissive photosensor that reads the pattern of the encoder scale 121 is provided to the carriage 23. The encoder scale 121 and the encoder sensor 122 together constitute a linear encoder (main scanning encoder) 123 that detects movement of the carriage 23.

As shown in FIG. 2, a servicing mechanism 9 that services the nozzles 124*b* in the recording heads 24 is provided outside the imaging range of the image forming apparatus 100 in the main scanning direction. The servicing mechanism 9 includes a suction cap 92*a* and a cap 92*b* that respectively cap the nozzle surfaces 124 of the recording heads 24 to keep the recording heads 24 moisturized when the carriage 23 is at a home position, a wiper 93 that wipes off the nozzle surfaces 124, and a receiver 94 that receives ink droplets not used for image formation and preliminarily ejected from the recording heads 24 for maintenance to remove coagulated ink from the recording heads 24. The suction cap 92*a* is connected to a suction pump 96 serving as a suction member connected to a waste tank 97, and is provided with a closably openable release valve 98 serving as a valve member that opens or closes a sealed space 194, which is formed within the suction cap 92*a* when the nozzle surface124 of the recording head 24*a* or 24*b* is capped with the suction cap 92*a*, to atmosphere.

The sheet 10 stored in the sheet feed tray 4 is fed one by one by a sheet feed roller 43 and a separation pad 44 and is conveyed along a guide member 45 to a portion between an endless conveyance belt 51 and a pressing roller 48, each included in the conveyance mechanism 5. The sheet 10 attracted to the conveyance belt 51 is then conveyed by the conveyance belt 51.

The conveyance belt 51 is wound around a conveyance roller 52 serving as a drive roller and a driven roller 53. The conveyance mechanism 5 further includes a charging roller 54 that charges the conveyance belt 51 and a platen member 55 that provides flatness to the conveyance belt 51 at a portion opposite the image forming unit 2.

The conveyance belt 51 is rotated in the sub-scanning direction, that is, a direction of conveyance of the sheet 10, by the conveyance roller 52 rotated by a sub-scanning motor 151 via a timing belt 152 and a timing pulley 153. Hereinafter, a part of the conveyance belt 51 from the conveyance roller 52 to the driven roller 53 in a direction of rotation of the conveyance belt 51, that is, a part of the conveyance belt 51 facing the image forming unit 2 to convey the sheet 10 upward, is referred to as a normal conveyance part 51*a*, and the other part of the conveyance belt 51 from the driven roller 53 to the conveyance roller 52 is referred to as a reversal conveyance part 51*b*.

The conveyance mechanism 5 further include a cord wheel 154 attached to a shaft 52*a* of the conveyance roller 52 and an encoder sensor 155 including a transmissive photosensor to detect a pattern formed in the cord wheel 154. The cord wheel 154 and the encoder sensor 155 together constitute a rotary encoder (sub-scanning encoder) 156 that detects an amount of movement and a position of the conveyance belt 51.

The discharge unit 6 includes a discharge guide member 61, a discharge conveyance roller 62, a first spur 63, a discharge roller 64, and a second spur 65. The sheet 10 having the image thereon is discharged between the discharge roller 64 and the second spur 65 to the discharge tray 7, with the side having the image thereon facing down.

The reversal unit 8 includes a changeover pick 81 that switches a direction of conveyance of the sheet 10 between a discharge path and a reversal path. Specifically, the changeover pick 81 reverses the direction of conveyance of the sheet 10, a part of which is discharged to the discharge tray 7, using a switchback system so that the sheet 10 is conveyed backward between the conveyance belt 51 and the pressing roller 48. The reversal unit 8 further includes a reversal guide member 82, a reversal roller 83, a third spur 84, a driven auxiliary roller 85 provided opposite the driven roller 53, and a diversion guide member 86 that diverts the sheet 10 separated from the reversal conveyance part 51*b* of the conveyance belt 51 to the charging roller 54 so as to guide the sheet 10 between the conveyance belt 51 and the pressing roller 48.

In the image forming apparatus 100 having the above-described configuration, the sheet 10 fed one by one from the sheet feed tray 4 is electrostatically attracted to the charged conveyance belt 51, and is vertically conveyed upward by the rotation of the conveyance belt 51. The recording heads 24 are driven based on an image signal while the carriage 23 is moved so that ink droplets are ejected from the recording heads 24 to the sheet 10, which remains stationary, so as to form a single line in an image to be formed on the sheet 10. Thereafter, the sheet 10 is moved by a predetermined amount to perform image formation of the next line. Upon completion of image formation, the sheet 10 having the image thereon is discharged to the discharge tray 7.

During servicing of the nozzles 124*b* of the recording heads 24, the carriage 23 is moved to the home position opposite the servicing mechanism 9. The nozzle surface 124 of the recording head 24*a* is capped with the suction cap 92*a* so that coagulated ink is sucked out and ink droplets not used for image formation are ejected from the nozzles 124*b* for maintenance, thereby achieving optimal ejection of ink droplets to form higher-quality images. When servicing the nozzles 124*b* of the recording head 24*b*, the carriage 23 is moved in the main scanning direction such that the nozzle surface 124 of the recording head 24*b* is positioned opposite the suction cap 92*a*. The suction cap 92*a* caps the nozzle surface 124 of the recording head 24*b* to suck out coagulated ink from the nozzles 124*b*.

During duplex image formation, after the image is formed on the front side of the sheet 10 with the processes described above, the discharge roller 64 is reversely driven when a trailing edge of the sheet 10 passes the changeover pick 81. As a result, the sheet 10 is guided backward to the reversal guide member 82 and is further conveyed by the reversal roller 83 and the third spur 84 between the reversal conveyance part 51*b* of the conveyance belt 51 and the driven auxiliary roller 85.

Thus, the sheet 10 is attracted to the conveyance belt 51 and is conveyed by the rotation of the conveyance belt 51. The sheet 10 is then separated from the conveyance belt 51 at the conveyance roller 52 to be guided to the diversion guide member 86. Thereafter, the sheet 10 is again conveyed between the normal conveyance part 51*a* of the conveyance belt 51 and the pressing roller 48 and is attracted to the conveyance belt 51. After an image is formed on the back side of the sheet 10 by the recording heads 24, the sheet 10 is discharged to the discharge tray 7.

It is to be noted that the charging roller 54 is provided inboard of the diversion guide member 86 so that the sheet 10 is always attracted to the conveyance belt 51 newly charged by the charging roller 54.

Figure 4:
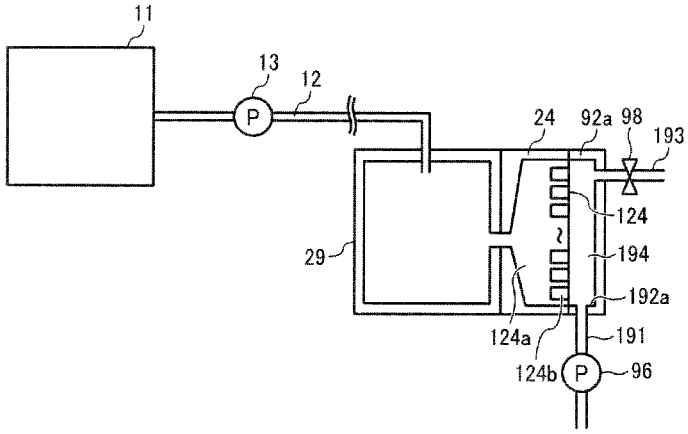
FIG. 4 is a schematic view illustrating an example of a configuration of a system for supplying and ejecting ink employed in the image forming apparatus.

A description is now given of a system used for supplying and ejecting ink employed in the image forming apparatus 100 with reference to FIG. 4. FIG. 4 is a schematic view illustrating a configuration of a system for supplying and ejecting ink employed in the image forming apparatus 100.

The main tank 11 is detachably attachable to the image forming apparatus 100 and stores ink to be ejected from the recording heads 24. A supply tube 12 disposed between the main tank 11 and the head tank 29 connects the main tank 11 and the head tank 29, and is provided with a supply pump 13. In the present embodiment, the supply pump 13 is a reversible pump. The supply pump 13 serving as a liquid supplier is normally driven to supply ink from the main tank 11 to the head tank 29, and is reversely driven to return the ink from the head tank 29 to the main tank 11.

The recording heads 24 and the head tank 29 are coupled to each other via a filter unit, not shown. In the recording heads 24, ink is supplied from the head tank 29 to a common liquid chamber 124*a*, and the ink is further supplied from the common liquid chamber 124*a* to separate liquid chambers, not shown. The ink thus supplied to the separate liquid chambers is pressurized so that ink droplets are ejected from the nozzles 124*b*. Negative pressure is generated in the head tank 29 by reversely driving the supply pump 13 so as to return the ink from the head tank 29 to the main tank 11.

The suction cap 92*a* that caps the nozzle surface 124 of the recording head 24*a* or 24*b* is disposed vertically corresponding to the recording heads 24, and is moved back and forth relative to the recording heads 24 by a cap moving mechanism 531. A discharge path 191 connected to the waste tank 97 is connected to a bottom surface 192*a* of the suction cap 92*a* in the vertical direction, and is provided with the suction pump 96. A release path 193 that releases the sealed space 194 formed within the suction cap 92*a* while the suction cap 92*a* caps the nozzle surface 124 of the recording head 24*a* or 24*b* is connected to an upper part of the suction cap 92*a* in the vertical direction, and is provided with the release valve 98 that opens and closes the release path 193.

Figure 5:
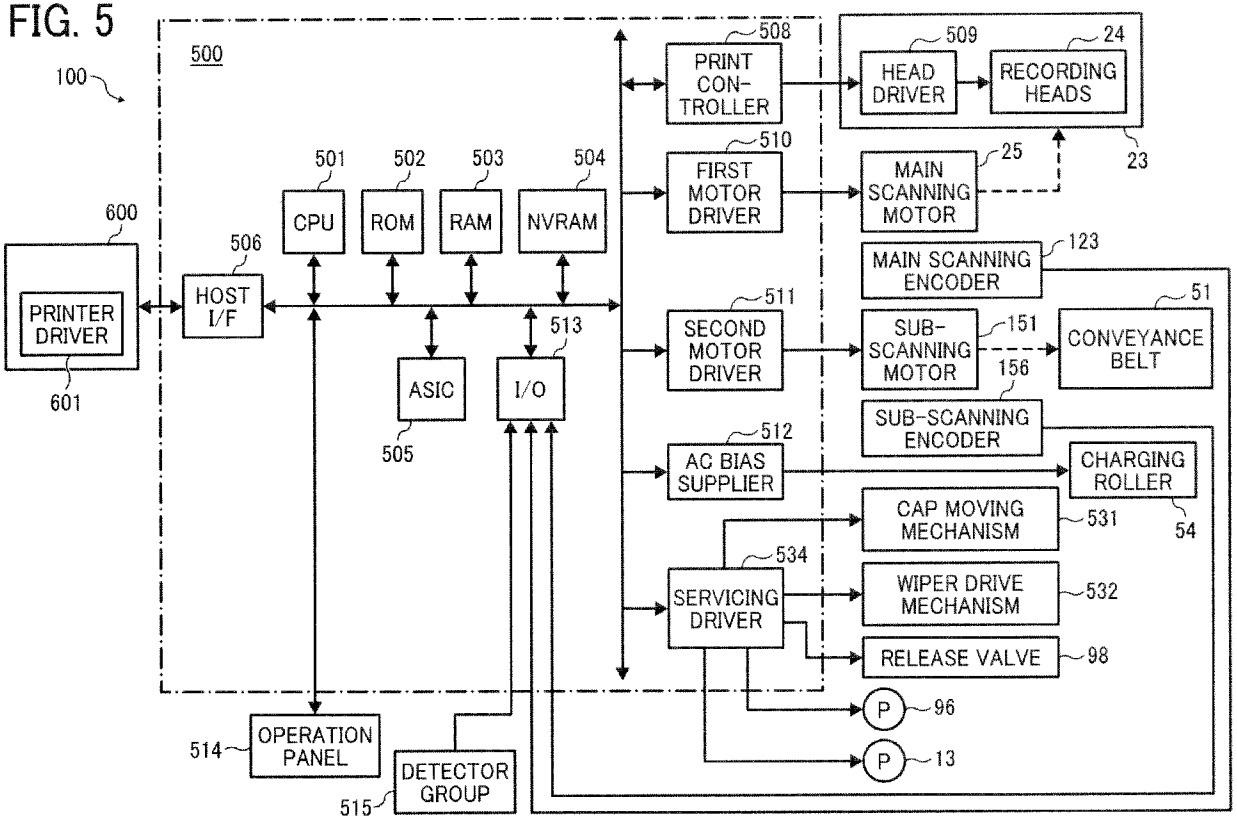
FIG. 5 is a block diagram illustrating an example of a configuration of a control unit included in the image forming apparatus.

A description is now given of an example of a configuration and operation of a control unit 500 employed in the image forming apparatus 100 with reference to FIG. 5. FIG. 5 is a block diagram illustrating an example of a configuration of the control unit 500.

The control unit 500 controls the image forming apparatus 100 and includes a CPU 501, a ROM 502 storing fixed data and various programs including a program that causes the CPU 501 to perform processing related to the present embodiment, a RAM 503 that temporarily stores image data and so forth, a nonvolatile rewritable memory (NVRAM) 504 that holds data while no power is supplied to the image forming apparatus 100, and an ASIC 505 that performs signal processing of image data and image processing, such as sorting of the image data, and handles input/output signals for controlling the image forming apparatus 100.

The control unit 500 further includes a print controller 508 including a data transfer unit for controlling driving of the recording heads 24 and a drive signal generator, a head driver (driver IC) 509 that drives the recording heads 24 provided to the carriage 23, first and second motor drivers 510 and 511 that respectively drive the main scanning motor 25 for moving the carriage 23 and the sub-scanning motor 151 for rotating the conveyance belt 51, and an AC bias supplier 512 that supplies an AC bias to the charging roller 54.

An operation panel 514 through which data necessary for the image forming apparatus 100 is input and on which such data is displayed is connected to the control unit 500.

The control unit 500 receives image data and so forth sent from a host device 600 including an information processing device such as a personal computer, an image reading device such as an image scanner, or an imaging device such as a digital camera, using a host I/F 506 through a cable or a network, which may be either wired or wireless.

The CPU 501 of the control unit 500 reads image data from a reception buffer included in the host I/F 506 and analyzes the image data so that image processing and sorting of the image data are performed by the ASIC 505 as needed. The resultant image data is transferred from the print controller 508 to the head driver 509.

It is to be noted that dot pattern data for outputting an image on the sheet 10 is generated by a printer driver 601 provided to the host device 600.

The print controller 508 transfers the above-described image data as serial data to the head driver 509 and outputs a transfer clock, a latch signal, a control signal, and so forth, each necessary for transferring the image data and confirming transfer of the image data to the head driver 509. In addition, as described above, the print controller 508 includes the drive signal generator having a voltage amplifier, a current amplifier, a D/A converter that performs digital/analog conversion of pattern data of a drive signal stored in the ROM 502, and so forth, and outputs a drive signal formed of a single drive pulse or multiple drive pulses to the head driver 509.

The head driver 509 selectively applies the drive pulse forming the drive signal output from the print controller 508 to a drive element such as a piezoelectric element that generates energy to drive the recording heads 24 to eject the ink droplets based on a single line of the image data serially input to the recording heads 24. At this time, a size of a dot of the ink droplet ejected from the recording heads 24 can be changed to small, medium, or large by selecting the drive pulse that forms the drive signal as appropriate.

An I/O 513 acquires data from the main scanning encoder 123, the sub-scanning encoder 156, and a detector group 515 attached to the image forming apparatus 100, and extracts data necessary for control of the image forming apparatus 100 to control the print controller 508, the first and second motor drivers 510 and 511, and the AC bias supplier 512. The detector group 515 includes an optical detector 521 provided to the carriage 23 to detect a position of the sheet 10, a thermistor that monitors temperature and humidity within the image forming apparatus 100, a detector that monitors a voltage on a charging belt, an interlock switch that detects whether a cover of the image forming apparatus 100 is opened or closed, and so forth. The I/O 513 handles various data from the detector group 515.

The CPU 501 calculates a drive output value (or a control value) for the main scanning motor 25 based on a speed detection value and a position detection value, each obtained by sampling a detection pulse output from the encoder sensor 122, and a target speed value and a target position value obtained from prestored speed and position profiles, so that the main scanning motor 25 is driven by the CPU 501 through the first motor driver 510. Similarly, the CPU 501 calculates a drive output value (or a control value) for the sub-scanning motor 151 based on a speed detection value and a position detection value, each obtained by sampling a detection pulse output from the encoder sensor 155, and a target speed value and a target position value obtained from prestored speed and position profiles, so that the sub-scanning motor 151 is driven by the CPU 501 through the second motor driver 511.

The control unit 500 also controls, via a servicing driver 534, the cap moving mechanism 531 that moves the suction cap 92*a* and the cap 92*b* back and forth relative to the nozzle surfaces 124 of the recording heads 24, the wiper drive mechanism 532 that drives the wiper 93, the supply pump 13, the suction pump 96, and the release valve 98 to supply ink and service the recording heads 24.

Figure 6:
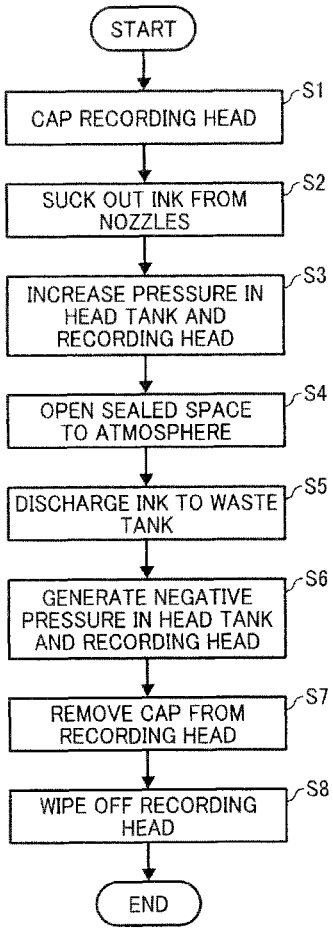
FIG. 6 is a flowchart illustrating steps in a process of servicing the recording heads.
Figure 7:
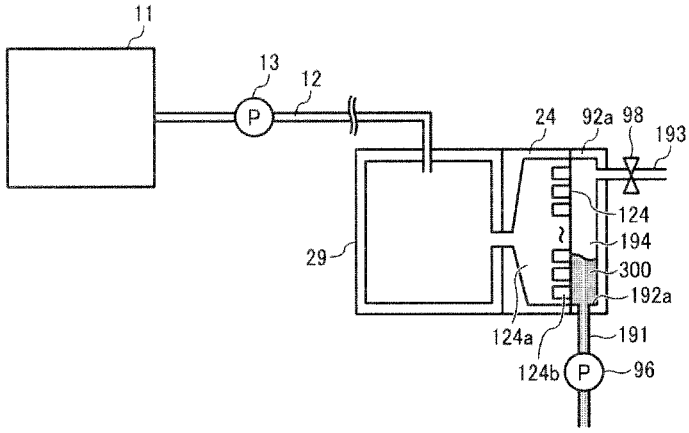
FIG. 7 is a schematic view illustrating an example of a configuration of the system for supplying and ejecting ink when ink is sucked out from nozzles during servicing of the recording heads.
Figure 8:
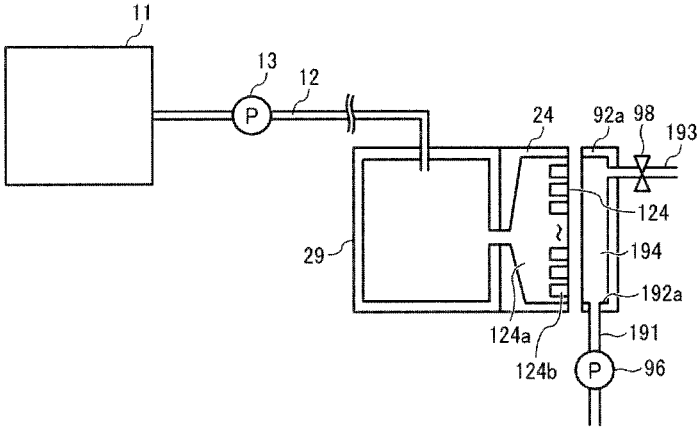
FIG. 8 is a schematic view illustrating an example of a configuration of the system for supplying and ejecting ink when a suction cap is removed from the recording heads during servicing of the recording heads.

A description is now given of servicing of the recording heads 24 with reference to FIGS. 6, 7, and 8. FIG. 6 is a flowchart illustrating steps in a process of servicing the recording heads 24. FIGS. 7 and 8 are schematic views respectively illustrating a configuration of the system for supplying and ejecting ink during servicing of the recording heads 24.

Referring to FIG. 6, at step S1 the recording heads 24 are positioned at a main scanning position so as to face the suction cap 92*a*, and the cap moving mechanism 531 is driven to move the suction cap 92*a* such that the nozzle surface 124 of the recording head 24*a* or 24*b* is capped with the suction cap 92*a*. At this time, the release valve 98 is closed.

At step S2, the suction pump 96 is driven to generate negative pressure in the sealed space 194 within the suction cap 92*a* so that the ink is sucked out from the nozzles 124*b* of the recording head 24*a* or 24*b* to the suction cap 92*a*. Accordingly, as illustrated in FIG. 7, ink 300 is discharged within the suction cap 92*a*. Because the recording heads 24 and the suction cap 92*a* are disposed vertically, the ink 300 is accumulated on the bottom surface 192*a* of the suction cap 92*a* within the sealed space 194.

After the ink is sucked out from the nozzles 124*b*, at step S3 the supply pump 13 is normally driven so that the ink is supplied from the main tank 11 to the head tank 29 to reduce the negative pressure in the head tank 29 and the recording head 24*a* or 24*b* or to generate positive pressure in the head tank 29 and the recording head 24*a* or 24*b*.

At step S4, the release valve 98 is opened to open the sealed space 194 to atmosphere. At this time, at step S5 the suction pump 96 is kept driving or is driven again so as to discharge the ink 300 remaining in the suction cap 92*a* to the waste tank 97 via the discharge path 191.

At step S6, the supply pump 13 is reversely driven so that the ink in the head tank 29 is returned to the main tank 11 so as to generate predetermined negative pressure in the head tank 29 and the recording head 24*a* or 24*b*.

At step S7, the cap moving mechanism 531 is driven to separate the suction cap 92*a* from the nozzle surface 124 of the recording head 24*a* or 24*b* as illustrated in FIG. 8. At step S8, the wiper 93 wipes off the nozzle surface 124 of the recording head 24*a* or 24*b* to clean the nozzle surface 124.

Thereafter, ink droplets not used for image formation are ejected for maintenance.

The above-described servicing of the recording heads 24 provides the following non-predictable effects.

In the image forming apparatus 100, the nozzle surfaces 124 (or the nozzle arrays Na and Nb) of the recording heads 24 are disposed vertically. Accordingly, the ink sucked out from the nozzles 124*b* of the recording heads 24 accumulates on the bottom surface 192*a* of the suction cap 92*a* as illustrated in FIG. 7. Because the ink of the two different colors is ejected from the nozzle arrays Na and Nb of each of the recording heads 24, the colors of the ink 300 remaining in the suction cap 92*a* are mixed.

Meanwhile, negative pressure in the recording heads 24 and the head tank 29 is increased due to the suction of ink from the nozzles 124*b* of the recording heads 24.

Consequently, when the release valve 98 is opened to discharge the ink 300 from the suction cap 92*a* in such a state, the ink 300, the colors of which are mixed as described above, counterflows from the suction cap 92*a* into the nozzles 124*b*. As a result, ink with mixed colors is ejected from the nozzles 124*b* of the recording heads 24 for the next sequence of image formation, thereby degrading image quality.

In addition, when the suction cap 92*a*, within which the ink 300 still remains, is removed from the nozzle surface 124 in order to prevent counterflow of the ink 300 with mixed colors into the nozzles 124*b*, the ink 300 drips off from the suction cap 92*a* having an opening in the horizontal direction, thereby contaminating inside the image forming apparatus 100 with the ink.

To solve the above-described problems, after the suction of ink from the nozzles 124*b* at S2, the supply pump 13 is driven to supply ink from the main tank 11 to the head tank 29 to reduce the negative pressure in the head tank 29 and the recording heads 24 or to generate positive pressure in the head tank 29 and the recording heads 24. Accordingly, counterflow of the ink 300 remaining in the suction cap 92*a* into the nozzles 124*b* can be prevented. Thereafter, the release valve 98 is opened to open the sealed space 194 within the suction cap 92*a* to atmosphere to efficiently discharge the ink 300 from the suction cap 92*a*, thereby preventing the ink 300 from dripping off from the suction cap 92*a*.

Figure 9A:
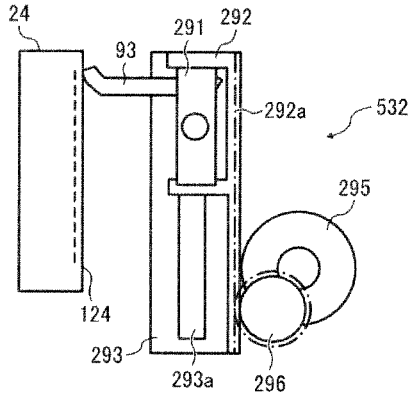
FIGS. 9A and 9B are schematic views respectively illustrating an example of a configuration of a wiper drive mechanism.
Figure 9B:
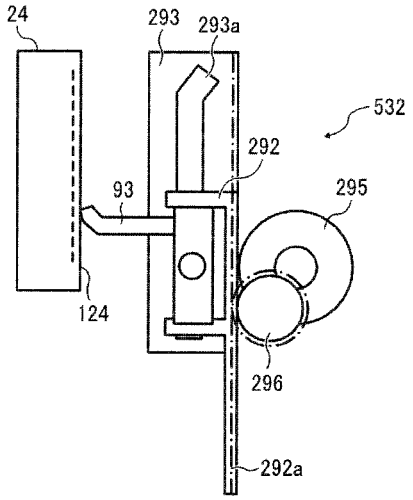

A description is now given of a configuration and operation of the wiper drive mechanism 532. FIGS. 9A and 9B are schematic views respectively illustrating an example of a configuration of the wiper drive mechanism 532.

The wiper drive mechanism 532 includes a holder 291 that holds the wiper 93 to wipe off the nozzle surfaces 124 of the recording heads 24. The holder 291 is held by a slider 292 having a rack 292*a*. The slider 292 is held movably along a guide groove 293*a* of a guide rail 293. A driving force is transmitted from a drive motor 295 constituted of a stepping motor to the rack 292*a* of the slider 292 via a pinion gear 296 so that the slider 292 is moved to move the wiper 93 downward as illustrated in FIG. 9B.

Figure 10:
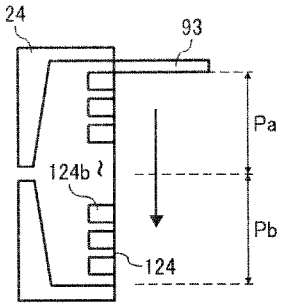
FIG. 10 is a schematic view illustrating an example of division of a nozzle surface of the recording head into multiple sections.

Thus, during wiping of the nozzle surfaces 124 of the recording heads 24, after the suction cap 92*a* is removed from the nozzle surface 124 of the recording head 24*a* or 24*b*, the wiper 93 is moved from top to bottom along the nozzle arrays Na and Nb in each of the nozzle surfaces 124 of the recording heads 24 disposed vertically as illustrated in FIG. 10 so as to remove ink adhered to the nozzle surfaces 124 and form a meniscus inside each of the nozzles 124*b*.

In particular, in a case of use of quick-drying ink, the viscosity of the ink adhered to the nozzle surfaces 124 rapidly increases. Wiping such viscous ink off from the nozzle surfaces 124 using the wiper 93 requires removal of ink adhered to the wiper 93, causing an increase in production costs. In addition, the viscous ink is accumulated before being discharged to the waste tank 97 and is adhered to the nozzle surfaces 124, thereby blotting the sheet 10.

To solve the above-described problems, ink is ejected from the nozzles 124*b* immediately before the wiper 93 passes the nozzles 124*b*.

As a result, a viscosity of the ink can be reduced, thereby enabling the wiper 93 to reliably wipe off the nozzle surfaces 124 of the recording heads 24.

Figure 11:
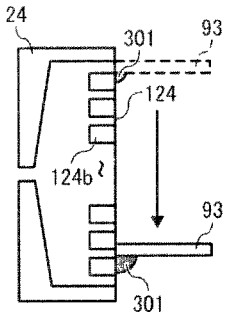
FIG. 11 is a schematic view illustrating an example of operation of the wiper drive mechanism.

Although a smaller amount of ink 301 is wiped off immediately after the start of wiping operation by the wiper 93 indicated by broken lines in FIG. 11, a cumulative amount of the ink 301 wiped off immediately before the end of wiping operation by the wiper 93 indicated by solid lines in FIG. 11 is larger. Consequently, the wiped ink 301 may be pushed inside the nozzles 124*b* as the wiper 93 is moved downward during the wiping operation.

Therefore, during the wiping operation, ink droplets which are not used for image formation are preliminarily ejected from the nozzles 124*b* for maintenance corresponding to the movement of the wiper 93 so as to prevent the wiped ink 301 from entering inside the nozzles 124*b*.

Setting an amount of preliminarily ejected ink relative to an amount of ink pushed inside the nozzles 124*b* when the wiper 93 is moved to a bottom part of the recording heads 24 increases a consumption amount of ink unnecessarily ejected from the nozzles 124*b* when the wiper 93 is moved to an upper part of the recording heads 24.

Therefore, the amount of ink preliminarily ejected is set for each section of the nozzle arrays Na and Nb such that a larger amount of ink is preliminarily ejected at a lower section of the nozzle arrays Na and Nb in the nozzle surfaces 124. As illustrated in FIG. 10, each of the nozzle surfaces 124 is divided into two sections, that is, an upper section Pa and a lower section Pb, and an amount of ink preliminarily ejected from the upper section Pa is set smaller than that ejected from the lower section Pb. Alternatively, each of the nozzle surfaces 124 may be divided into three sections or more to set an amount of ink preliminarily ejected from each of the divided sections.

As a result, consumption of ink can be reduced.

Figure 12:
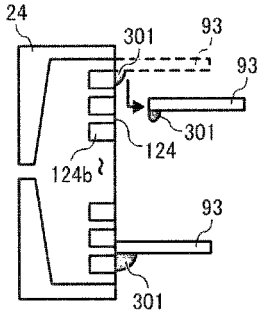
FIG. 12 is a schematic view illustrating another example of operation of the wiper drive mechanism.
Figure 13:
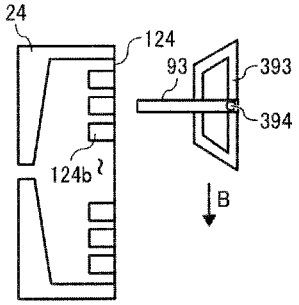
FIG. 13 is a schematic view illustrating an example of a configuration of a mechanism used for performing the operation illustrated in FIG. 12.

Further alternatively, as illustrated in FIG. 12, the ink 301 adhered to the wiper 93 may be removed after each of the divided sections in the nozzle surface 124 is wiped off, and then the wiper 93 may wipe off the next divided section in the nozzle surface 124. Specifically, as illustrated in FIG. 13, a guide pin 394 provided to the wiper 93 slidably engages the guide groove 393 so that the wiper 93 is moved along the guide groove 393 to contact to and separate from the nozzle surfaces 124. Accordingly, the wiper 93 is separated from the nozzle surfaces 124 after wiping off the corresponding divided section in the nozzle surface 124, and then a member in which the guide groove 393 is formed is moved in a direction indicated by arrow B so that the next divided section in the nozzle surface 124 is wiped off with the wiper 93.

As a result, an amount of ink 301 adhered to the wiper 93 for each divided section is reduced, thereby preventing the wiped ink 301 from entering inside the nozzles 124*b*.

It is to be noted that servicing of the recording heads 24 may be controlled by a computer executing programs stored in the ROM 502 or the like. The programs may be supplied through a storage medium or may be downloaded through a network such as Internet. In addition, the image forming apparatus 100 may be combined with the host device 600 such as a data processing device to constitute an image forming system.

The present illustrative embodiment is also applicable to a configuration in which the sheet 10 is conveyed in a direction slanted from the vertical direction and ink droplets are ejected in a direction slanted from the horizontal direction. Further, the present illustrative embodiment is also applicable to a line-type image forming apparatus.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

What is claimed is:

1. An image forming apparatus comprising:

a recording head having a nozzle surface in which nozzles to eject liquid droplets in a horizontal direction or a direction slanted from the horizontal direction are formed, the nozzle surface being disposed in a vertical direction or a direction slanted from the vertical direction;

a head tank to supply liquid to the recording head;

a suction cap to cap the nozzle surface of the recording head;

a suction member connected to the suction cap to suck out liquid from the nozzles by the suction cap;

a valve member to open or close a sealed space formed by capping the nozzle surface with the suction cap to atmosphere;

a liquid supplier to supply the liquid to the head tank and return the liquid from the head tank; and a control unit to control servicing of the recording head, the control unit causing the suction cap to cap the nozzle surface and the suction member to be driven so as to suck out liquid from the nozzles, the liquid supplier to supply the liquid so as to pressurize the head tank after the suction of liquid, the valve member to open the sealed space to atmosphere, the suction member to discharge liquid remaining in the suction cap after opening the sealed space to atmosphere, the liquid supplier to return the liquid from the head tank so as to form negative pressure in the head tank after the discharge of liquid, and the suction cap to be removed from the nozzle surface after the formation of negative pressure;

a wiper to wipe off the nozzle surface of the recording head; and a moving mechanism to move the wiper to wipe off the nozzle surface of the recording head from top to bottom, wherein liquid droplets not used for image formation are ejected from the nozzles in conjunction with movement of the wiper, the nozzle surface comprises multiple sections, and an amount of liquid droplets not used for image formation and preliminary ejected from the nozzles is set for each section, with an amount of liquid preliminarily ejected from the nozzles disposed in a lower section is greater than an amount of liquid preliminarily ejected from the nozzles disposed in an upper section.

2. The image forming apparatus according to claim 1, wherein:

the nozzles of the nozzle surface are arranged in multiple nozzle arrays, each array ejecting liquid of a different color; and the suction cap caps the entire nozzle arrays.

3. The image forming apparatus according to claim 1, wherein the nozzle surface is disposed at an angle to the vertical of not more than 45°.

4. A method for controlling servicing of a recording head included in an image forming apparatus comprising:

the recording head having a nozzle surface in which nozzles to eject liquid droplets in a horizontal direction or a direction slanted from the horizontal direction are formed, the nozzle surface being disposed in a vertical direction or a direction slanted from the vertical direction;

a head tank to supply liquid to the recording head;

a suction cap to cap the nozzle surface of the recording head;

a suction member connected to the suction cap to suck out liquid from the nozzles by the suction cap;

a valve member to open or close a sealed space formed by capping the nozzle surface with the suction cap to atmosphere;

a liquid supplier to supply the liquid to the head tank and return the liquid from the head tank; and a control unit to control the servicing of the recording head, the method comprising the steps of:

sucking out liquid from the nozzles by capping the nozzle surface with the suction cap and driving the suction member;

pressurizing the head tank by supplying the liquid using the liquid supplier after the sucking step;

opening the sealed space to atmosphere using the valve member;

discharging liquid remaining in the suction cap using the suction member after the opening of the sealed space to atmosphere;

forming negative pressure in the head tank by returning the liquid from the head tank using the liquid supplier after the discharging step;

removing the suction cap from the nozzle surface after the step of forming negative pressure in the head tank;

grouping the nozzles in the nozzle surface into discrete sections; and setting an amount of liquid droplets not used for image formation and preliminary ejected from the nozzles in the servicing variably for each section, wherein an amount of liquid preliminarily ejected from the nozzles disposed in a lower section is greater than an amount of liquid preliminarily ejected from the nozzles disposed in an upper section.

* * * * *